United States Patent [19]

Schroeder, Jr. et al.

[11] 4,300,612

[45] Nov. 17, 1981

[54] SAFETY ENCLOSURE FOR GLASS BOTTLES CONTAINING HAZARDOUS MATERIALS

[75] Inventors: William Schroeder, Jr., North Muskegon; Raymond N. Fink, Williamston, both of Mich.

[73] Assignee: Hoffmann-La Roche Inc., Nutley, N.J.

[21] Appl. No.: 91,005

[22] Filed: Nov. 5, 1979

[51] Int. Cl.[3] ..... B65D 23/08

[52] U.S. Cl. ..... 150/52 R; 215/12 R; 220/72

[58] Field of Search ..... 215/12 R, 13 R, 13 A, 215/11 C; 150/52 R, 52 F; 222/131, 183; 220/411, 412, 70, 72

[56] References Cited

U.S. PATENT DOCUMENTS

| | | | |
|---|---|---|---|
| 1,063,351 | 6/1913 | Hyatt | 215/12 R |
| 1,712,228 | 5/1929 | Payson | 215/12 R |
| 1,855,039 | 4/1932 | Wetmore | 215/13 R |
| 1,868,773 | 7/1932 | Staake | 215/12 R |
| 2,607,509 | 8/1952 | Hess | 220/72 X |
| 2,786,607 | 3/1957 | Moore | 222/183 |
| 2,834,505 | 5/1958 | Debs | 220/72 |
| 3,484,011 | 12/1969 | Greenhalgh | 222/183 X |
| 3,613,761 | 10/1971 | Moody | 215/12 R X |
| 4,002,257 | 1/1977 | Hatridge | 150/52 R X |
| 4,143,694 | 3/1979 | Gregory | 150/52 R X |

*Primary Examiner*—Donald F. Norton

*Attorney, Agent, or Firm*—Jon S. Saxe; Bernard S. Leon; George M. Gould

[57] ABSTRACT

A solvent and shatter resistant protector for glass bottles containing hazardous materials. The protector is comprised of opaque or transparent polymeric material and conforms substantially to the shape of the container to be protected. The container protector is made up of top and bottom portions each having respective cooperating means, such as a special threading arrangement, for separable engagement, which enables engagement to be maintained even in the event of experienced shocks sufficient to damage the protected glass container. The top portion has an aperture for providing access to the contents of the contents of the protected container without disengagement from the bottom portion.

6 Claims, 1 Drawing Figure

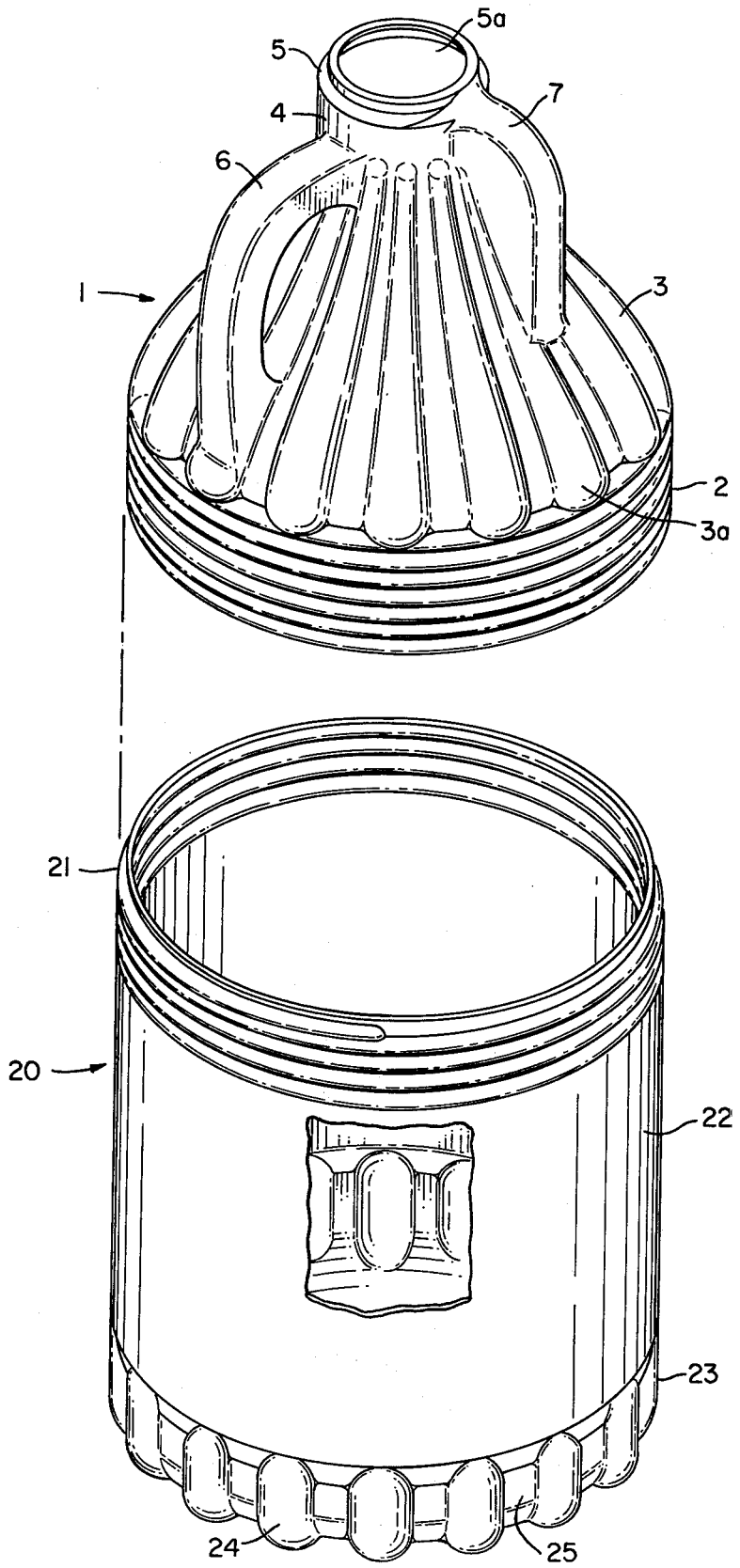
5a
5
7
4
6
1
3
2
3a
21
20
22
23
24
25

SAFETY ENCLOSURE FOR GLASS BOTTLES CONTAINING HAZARDOUS MATERIALS

BACKGROUND OF THE INVENTION

This invention relates to a shatter resistant safety enclosure for glass bottles and jugs which typically contain hazardous materials such as toxic, caustic or flammable liquids.

Recent years have seen a considerable increase in the use of flammable or hazardous solvents in the laboratory. The growth of analytical techniques such as gas chromatography and liquid chromatography demand the use of these hazardous materials for sample preparation and subsequent manipulation. Since large volumes are commonly necessary, the standard container has become the one-gallon glass bottle. Although the glass container is essential to preserve the integrity of the contents, the fragility and potential hazard from accidental breakage is of great concern to most users. Breakage of a gallon container of hazardous material can lead to exposure of workers to toxic or caustic fumes or liquids as well as create a substantial possibility of fire in the case of a flammable material.

One means currently in use for the protection of laboratory reagent bottles requires an integral coating of the bottle with polyvinyl chloride applied by a dipping process. The procedure leads to a solvent soluble coating which can subsequently lead to contamination of the contents and destruction of the coating by dribbling of the contents during use.

Another integral coating process in current use features a solvent resistant material that must be applied to a heated bottle. This eliminates the advantage of applying the protection after filling the container and again can lead to internal contamination of the bottle itself during the coating process. The hot bottle process is also inapplicable to some types of bottles, for example, those that cannot stand the shock of the rapid heating and cooling demanded by the process.

A third type of protective device currently in use is a heavy, pre-molded plastic pail type container with a snap down lid. The shape and configuration of this device are such that it is heavy and ungainly, has a non-integral handle and requires considerably more space in storage than the bottle guard according to the invention described herein. It is also not designed for use during the shipment of hazardous materials.

SUMMARY OF THE INVENTION

It is, therefore, a principal objective of this invention to provide a means by which these hazards and prior art drawbacks can be minimized and overcome, while preserving the integrity and purity of the glass bottle contents.

According to the broader aspects of the invention there is provided a container protector comprising separable top and bottom portions each composed of solvent and shatter resistant polymeric material and conforming substantially to the shape of the container to be protected, said top and bottom portions having respective cooperating means for separably engaging said portions such that accidental separation is prevented even in the face of shocks sufficient to damage the container.

Also according to the present invention there is provided a protective overcontainer for containers having potentially hazardous contents which is applicable to such containers even after filling, comprising separable top and bottom portions each composed of solvent and shatter resistant polymeric material and conforming substantially to the shape of the container to be protected, said top and bottom portions having respective cooperating means for separably engaging said portions such that accidental separation is prevented even in the face of shocks sufficient to damage the container to be protected, said top and bottom portions including respectively corrugated-like surface sections in the vicinity of the more breakage-susceptible portions of the protected container, and said top portion further including an aperture for providing access to the contents of the protected container without disengagement of the top and bottom portions.

While other means are available for the protection of glass containers, the device herein described has many significant advantages not found in others. For example, the protective device which comprises this invention provides almost complete containment of bottle contents should the inside glass container be broken, thereby affording ample time for the safe disposal of those contents.

More particularly, the device comprising this invention can be described as a plastic over-container, blow or injection molded, providing the following advantages and features:

1. Solvent resistant.
2. Shatter resistant.
3. Disposable.
4. Does not interfere with access to contents.
5. Conforms to bottle shape and therefore takes up very little more space than the container to be protected.
6. Provides extra protection during shipment.
7. Can be applied after the bottle has been filled.
8. Is assembled with a screw joint that is very strong and will not separate.
9. Provides a molded-in handle.
10. Light weight.
11. Can be transparent or opaque, depending upon the specific utility.
12. Inexpensive.

With the device according to the invention, the entire glass bottle is protected. The top portion thereof is especially designed to protect the neck area of the bottle, and provides an opening to allow access to the glass container's contents without removal of this top portion and provides further an appropriate internal recessed area to accommodate the handle of the protected glass container.

The top and bottom portions may, according to the invention, be made of strong, long-lasting polyethylene or polypropylene which are resistant to most industrial and laboratory solvents. Alternatively, in the event transparency of the safety enclosure is desired, the material utilized may be polyethylene terephthalate (PET) or a polycarbonate such as Lexan®. Particular advantages of a transparent enclosure are that the level of liquid contained in the protected glass container may be readily seen and so, of course, the container's label, thus obviating the need to remove the protected container in order to identify the protected substance or determine its amount and along with it any need to provide some external identification or indication of content.

The top and bottom portions of the safety enclosure are provided with cooperating threaded arrangements to effect a screw coupling, which on the one hand enables ease of assembly (and disassembly) of the closure around the protected container, and especially after the latter has been filled, and on the other hand provides a strong securing means which will prevent separation even under the impact of shock or blows strong enough to break the glass container inside. In addition, this threaded joint provides a means by which workers can visibly tell whether or not the top portion is secured onto the bottom portion (or vice versa) sufficiently and correctly. The strength of the threaded joint derives at least in part from the corrugated type structure which rounded threading provides. A further advantage of the threaded arrangement is that it provides vertical adjustablility which would permit the protector to accommodate bottles and jugs of different heights, while maintaining the integrity and strength of the threaded joint.

BRIEF DESCRIPTION OF THE DRAWING(S)

The above mention and other objects and features of the invention will become more apparent from the following detailed description of the invention taken in conjunction with the accompanying drawing, in which there is illustrated a safety enclosure device in exploded and perspective view showing engagable top and bottom portions.

DESCRIPTION OF THE PREFERRED EMBODIMENT(S)

As shown in the FIGURE, the device according to the invention is comprised of a top portion 1 and a bottom portion 20, typically made of the same material. The FIGURE depicts a generally opaque material such as polyethylene. The material may also be polypropylene, or polypropylene in combination with polyethylene.

The top portion of the safety enclosure is provided at its lower part with a threaded arrangement 2 comprising a series of rounded-edged threads. The threads in cross-section actually form a downward angle of between 30° and 60° with respect to the cross-sectional plane of the top portion. A preferred angle provides an approximate 45° downward slant of the threads. The greater part of the remainder of the top 1 comprises a section 3 of continuously shrinking diameter leading to the narrowed portion 4 which covers the neck and top portion of the protected container. Section 3 is provided with a series of longitudinally running ribs or corrugations 3*a* that extend from the threaded portion 2 to the neck portion 4 and near the upper most portion 5. The upper most part 5 is provided with a suitable opening 5*a* through which access to the contents of the container is maintained without having to disassemble the safety enclosure. Upper most section 5 may also be provided with threading (not particularly shown) thus enabling a cap to be secured onto top portion 1 to cover the opening 5*a*.

A handle 6 is also provided with top portion 1 which extends from the neck portion 4 to the lower most portion of section 3. In addition to providing means for conveniently carrying the safety enclosure, handle 6 is configured for strength and durability and provides an added measure of protection to the vulnerable neck area of the protected glass container. A similar function is provided by way of protrusion 7, which in actually constitutes an internal recessed area for housing the handle of the protected bottle. Thus, it can be appreciated that the top portion 1 is able to closely conform to the shape of the protected bottle and therefore requires very little additional space than that required for the protected container itself. This is true even in connection with the molded-in handle 6, the configuration of which can be readily limited to having the outer most projecting portion thereof (from the axial center of the safety enclosure) nevertheless remain inside the diameter of threaded portion 2.

Looking to the bottom portion 20 of the safety enclosure, there is provided at the upper most part thereof a threaded section 21 which is designed and configured to cooperate with threaded section 2 of the top portion 1, and like threaded section 2 is comprised of rounded-edged threads which provide for ease of assembly and disassembly as well as a corrugated-like structure for greater strength and stability and added protection to the midsection of the glass bottle. The threads of section 21 are also provided with the downwardly angled configuration characteristic of the section 2 threads. Also like section 2, section 21 is provided with three starting threads equispaced apart about the circumference of the bottle guard. Of particular advantage is the fact that the angled threading positively biases the safety enclosure to have the top and bottom portions remain assembled. This positive bias effectively prevents separation other than by relative rotation of the top and bottom portions and virtually eliminates any practical possibility of the threads becoming sheared or stripped or otherwise weakened by accidental shock or force sustained by the bottle guard. The angled threading in effect affords a means of self-protection. Thus, when threaded sections 2 and 21 are assembled together, the threaded joint provided thereby is fully effective to prevent separation of the top 1 and bottom 20 portions, even in the face of blows or shocks strong enough to break the enclosed glass bottle.

The major part of bottom portion 20 in terms of surface area is the cylindrical section 22 lying between threaded section 21 and a base arrangement 23. Section 22 is cyclindrical in shape inter alia for providing a convenient surface for a label, or for providing an undistorted viewing of the bottle's own label in the case of the safety enclosure being transparent.

The base section 23 of bottom portion 20 is comprised of a broad, substantially flat, though slightly recessed bottom surface, and a series of elongated equispaced apart convexly-shaped side ribs or nodular protrusions 24 overlying a circumferentially running area 25 of reduced diameter proximate the bottom surface of bottom portion 20. The internal surface of the base section 23 may be seen through the break-away window in the figure provided for ease of illustration. This particular base design provides an extra measure of strength and durability in that most important bottom area of the protected container and also enables easier gripping e.g. with the hand for assembly/disassembly of the bottle guard top and bottom portions.

Like the top portion 1, the bottom portion 20 is configured to closely conform to the shape of the protected container, which typically would be in the one-gallon glass bottle. Thus, little additional space is needed over that required for the protected container itself, and therefore there would be no need for change in carton size, an advantage to users having storage facilities designed for cartons currently in use.

The entire safety enclosure lends itself to either blow or injection molding, and with such possible solvent and shatter resistant transparent materials as polyethylene terephthalate (PET) or polycarbonate. In considering the safety enclosure as an assembly, a principal advantage is that the enclosure may be applied after the protected bottle has been filled.

Another way of fastening the top and bottom portions together is to provide same with suitable cooperating elements in the regular molding process which when engaged comprise a latching type locking factor for holding the two portions securely together.

What is claimed is:

1. A container protector comprising separable top and bottom portions, each composed of a solvent and shatter resistant polymeric composition, said top and bottom portions being configured so as to conform substantially to the shape of a container to be protected, said top and bottom portions having respective cooperating means on one edge of each for separably engaging said portions such that accidental separation is prevented even under conditions of stress sufficient to damage the container, said top portion having an aperture formed in the other edge which provides access to the contents of the protected container without requiring separation on the top portion from the bottom portion, said top portion being provided with a series of rib-like protrusions longitudinally extending along the surface of the top portion from about the edge containing the separable cooperating means to the edge containing the aperture, said separable engaging means comprising thread means on said one edge of the top portion and said one edge of the bottom portion which threadably engage each other.

2. A container protector as in claim 1 including means formed integral with the top portion for permitting said container to be carried.

3. A container protector according to claim 2 wherein said means permitting carrying of the container comprises a handle which forms an integral part of the top portion.

4. A container protector according to claim 3 wherein said bottom portion includes a cylindrical surface area which permits viewing of a label identifying the contents within the container to be protected.

5. A container protector according to claim 1 wherein said bottom portion is substantially cylindrical in shape and includes a base section providing a broad substantially flat, tip-resistant surface and having a series of elongated longitudinally extending circumferentially spaced protrusions adjacent the base section for enabling said protector to safely sustain shocks sufficient to otherwise damage the container to be protected.

6. A container protector according to claim 5 wherein said base section further includes a circumferentially extending section of narrowed diameter which engages said rib-like protrusions.

* * * * *